US006138586A

United States Patent [19]

Reichart

[11] Patent Number: 6,138,586

[45] Date of Patent: Oct. 31, 2000

[54] METHOD AND DEVICE FOR INCINERATION OF EXHAUST GASES

[75] Inventor: Johannes Reichart, Kirchheim, Germany

[73] Assignee: Utec Luftreinigung + Warmeruckgewinnung-Anlagenbau GmbH, Germany

[21] Appl. No.: 09/261,859

[22] Filed: Mar. 3, 1999

[30] Foreign Application Priority Data

Mar. 3, 1998 [DE] Germany ..... 198 08 819

[51] Int. Cl.[7] ..... F23B 5/00; F23G 7/06; F23J 15/00

[52] U.S. Cl. ..... 110/211; 110/212; 110/345; 431/5

[58] Field of Search ..... 110/210, 211, 110/212, 213, 342, 344, 345; 431/5, 2, 353, 171

[56] References Cited

U.S. PATENT DOCUMENTS

| | | | |
|---|---|---|---|
| 665,658 | 1/1901 | Jankus | 110/97 |
| 2,369,995 | 2/1945 | Arnold | 110/97 |
| 2,889,002 | 6/1959 | Kocee | 183/6 |
| 3,164,445 | 1/1965 | Hampel | 23/277 |
| 3,194,215 | 7/1965 | Barnes | 122/235 |
| 3,218,134 | 11/1965 | Walsh | 23/277 |
| 3,380,410 | 4/1968 | Venable | 110/97 |
| 3,738,816 | 6/1973 | Hirt | 23/277 C |
| 3,898,040 | 8/1975 | Tabak | 23/277 |

FOREIGN PATENT DOCUMENTS

| | | | |
|---|---|---|---|
| 0 717 239 A2 | 6/1996 | European Pat. Off. | F23D 14/02 |
| 28 08 874 C2 | 9/1979 | Germany | F23D 11/36 |
| 33 12 863 A1 | 10/1984 | Germany | F23G 7/06 |

*Primary Examiner*—Denise L. Ferensic
*Assistant Examiner*—Ken B. Rinehart
*Attorney, Agent, or Firm*—Pendorf & Cutliff

[57] ABSTRACT

A method for incineration and an incinerator for composition of exhaust gases containing organic substances, the incinerator comprising an elongated, preferably cylindrical combustion chamber, an oil or gas fired burner with a flame-tube axially centrally at one end of the combustion chamber, a flue gas outlet pipe provided at the end of the combustion chamber opposite to the burner for the flue gases produced during incineration, and an inlet conduit connected to the side of the combustion chamber for the exhaust gases to be decomposed, wherein the inlet feed pipe opens or discharges in the combustion chamber in proximity to the burner. The incinerator is characterized by a conduction/deflection plate (36), adjacent the input conduit (24), for pre-heating the exhaust gases flowing by. The inner surface (38) of the conduction/deflection plate (36) serves as conduction surface for the flame emitted axially from the burner (18) into the combustion chamber (14), while the outer surface (40) serves as conduction and deflection surface for the exhaust gas entering into the combustion chamber (14) via input conduit (24) with radial flow component. The incinerator thus achieves a higher heat density and a more compact construction of the combustion chamber (14).

18 Claims, 2 Drawing Sheets

METHOD AND DEVICE FOR INCINERATION OF EXHAUST GASES

BACKGROUND OF THE INVENTION

1. Field of the Invention

The invention concerns an incinerator for decomposition (pyrolysis) of exhaust gases loaded with organic substances, comprising an elongated, preferably cylindrical combustion chamber, an oil or gas fired burner with a flame-tube axially centrally at one end of the combustion chamber, a flue gas outlet pipe provided at the end of the combustion chamber opposite to the burner for the flue gases produced during incineration, and an inlet conduit connected to the side of the combustion chamber for the exhaust gases to be decomposed, wherein the inlet feed pipe opens or discharges in the combustion chamber in proximity to the burner.

2. Description of the Related Art

In the field of exhaust air cleansing and exhaust gas disposal, incineration is the most universal and secure method for elimination of combustible organic contents. The air loaded with harmful substances is heated to a high temperature in an incinerator so that the organic materials essentially combust to carbon dioxide and water. The necessary high temperatures are achieved by a combustion flame with the help of a burner, while the flue gases resulting from the combustion process are either conveyed to a chimney or a flue gas cleanser or scrubber. In the known incinerators it is considered a disadvantage, that the combustion chamber with the given exhaust gas throughput must be constructed to be relatively long, which results in a large volume construction manner of the combustion oven.

SUMMARY OF THE INVENTION

Beginning therewith it is a task of the invention to develop an incinerator, which for a predetermined exhaust gas throughput or flow-through makes possible a relatively short construction.

The inventive solution is based on the idea of heating the exhaust gases to be combusted to a high temperature in the shortest possible distance, so that the shortest possible manner of construction can be achieved.

In order to make this possible, according to a first embodiment of the invention there is provided in the combustion chamber eccentrically on the side of the inlet conduit a conduction/deflection plate with edges at least partially for flow-around, of which the inner surface serves as conduction surface for the flame from the burner entering the combustion chamber essentially axially, and of which the outer surface serves as deflection and conveyance surface for the exhaust gases entering the combustion chamber via the inlet conduit with a radial flow component. For this the conduction/deflection plate extends essentially axially parallel out from the burner over the width of the inlet conduit and is preferably formed of curved sheet metal forming part of a cylinder essentially concentric in the combustion chamber. By this measure it is achieved, that the exhaust gases flowing into the combustion chamber do not impact immediately upon the burner flame, but rather in a short as possible distance are first preheated and brought to turbulence at the outer surface of the conveyance/deflection plate and on the wall of the combustion chamber, so that upon meeting the flame they come up to the flame temperature in a very short distance.

A further improvement or alternative embodiment of the invention envisions, that downstream of the inlet conduit a baffle plate is provided axially centrally, transverse to the longitudinal axis of the combustion chamber, and close to the free end of the conveyance/deflection plate, and preferably connected to the conduction/deflection plate via axially parallel spacers. With these measures it is achieved, that the axial projection of the flame is shortened and the heat density essentially corresponding to the volume within the combustion oven is increased. As a consequence, with a conventional oil or gas burner in the combustion chamber a temperature of up to 1,100° C. is achieved, which under conditions of sufficient oxygen supply leads to a near complete oxidation of the organic substances contained in the exhaust gas in the shortest combustion path.

The further improvement in this respect is achieved thereby, that in the combustion chamber there are provided two axially spaced apart, perforated baffle plates, and that in the space between the two baffles a constriction of the combustion chamber is located. The constriction is formed by a ring concentric to the longitudinal axis of the combustion chamber and extending radially into the combustion chamber. A further constriction of the combustion chamber cross-section can also be provided between the flue gas outlet pipe and an adjacent baffle. The ring-shaped constriction and the impact sheets ensure an intense turbulent mixing within the combustion chamber and through mixing of the exhaust gases to be combusted with the flame-forming gas, wherein the perforations in the impact sheet facilitate the coefficient of penetration of the flame along the flow path. Preferably the metal tube defining the cylindrical combustion chamber is provided within a thermally insulated housing. All construction components are preferably made of a high-temperature-resistant steel. The housing, which preferably exhibits a substantially parallelepiped shape, in order to produce a natural flow-through, is preferably set up with a diagonally downward facing burner end face and with a diagonally upward facing flue gas conduit. An upward facing chimney can be connected to the flue gas conduit, while the input conduit provided in the area of the burner can connected to a exhaust gas pipe, preferably from below, which may include a blower.

The inventive device is preferably employed for incineration of volatile aromatic and hazardous substances. This includes in particular the combustion or incineration of smoking and baking exhaust gases, exhaust gases from rubber tempering ovens, and volatile organic solvents. A further possibility utility is the post-combustion of motor exhaust gases.

BRIEF DESCRIPTION OF THE DRAWINGS

In the following the invention will be described in greater detail on the basis of an embodiment shown schematically in the drawings. There is shown in FIG. 1 a perspective side view of an exhaust gas incinerator.

DETAILED DESCRIPTION OF THE INVENTION

Figure 1:
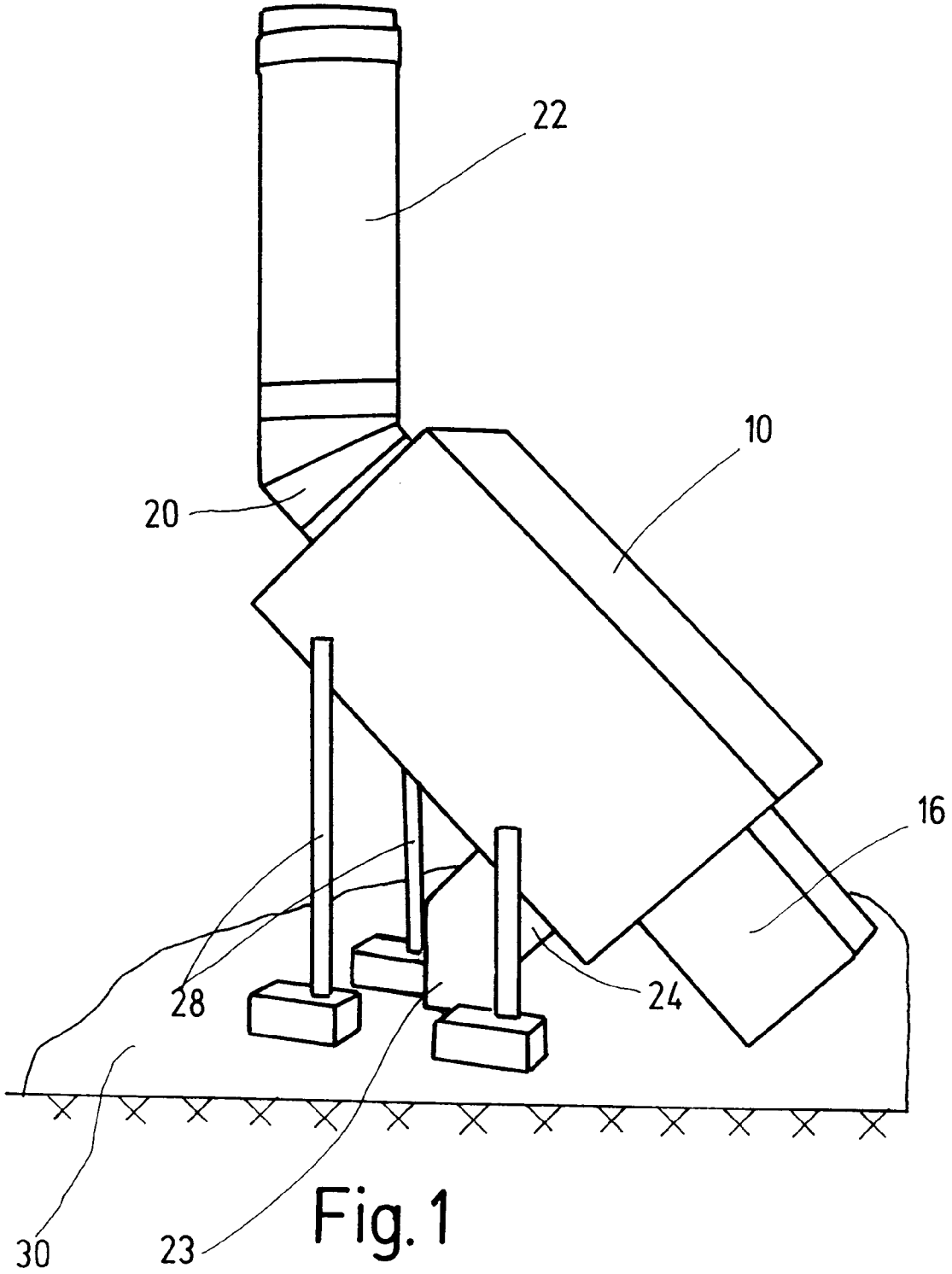
Figure 2:
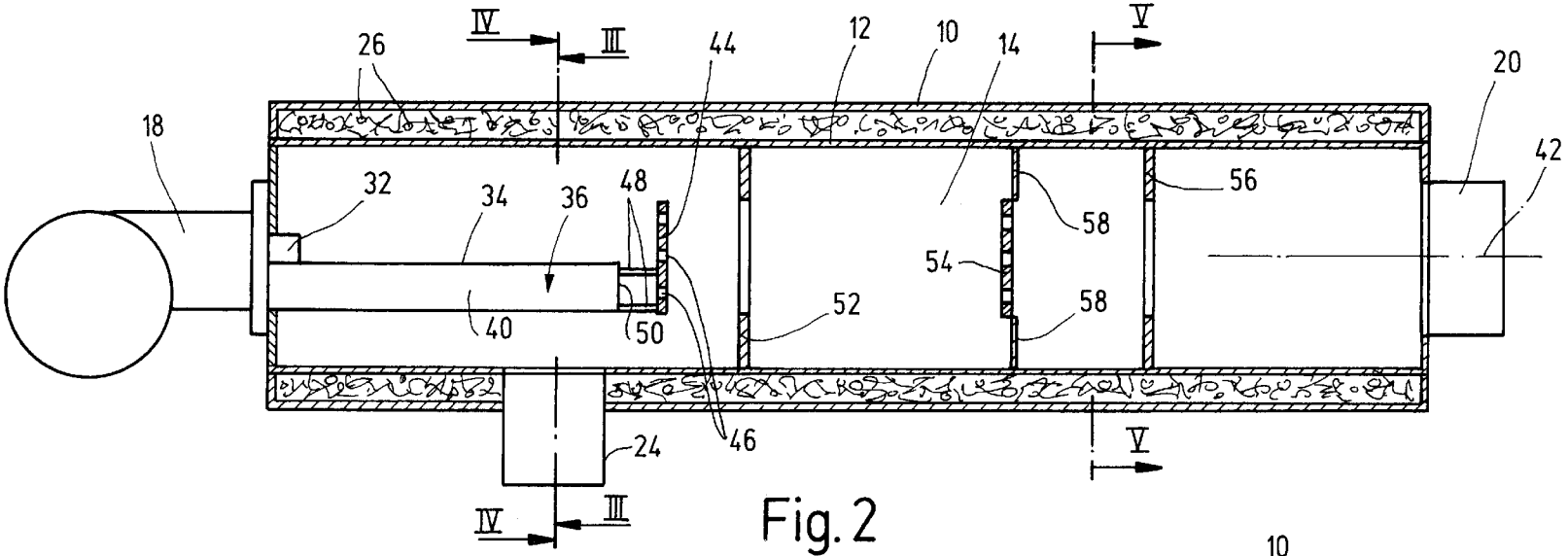
FIG. 2 a longitudinal section through the incinerator according to FIG. 1.
Figure 5:
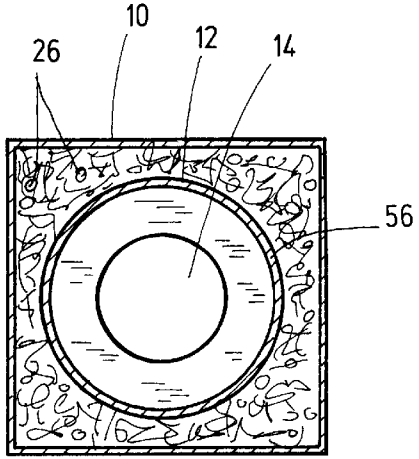
FIG. 5 a section along the section line V—V of FIG. 2.

The incinerator shown in FIG. 1 is designed for incineration of, for example, smoke-house or curing exhaust gases. It is comprised of an essentially parallelepiped shaped housing 10 in which a combustion pipe 12 with a cylindrical combustion chamber 14 is provided, a burner housing 16 provided at one end, a burner 18 connected to the combustion pipe 12 and supplied with heating oil or heating gas, a chimney 22 connected to a flue gas conduit 20 of the combustion pipe 12, and an input conduit 24 opening into the side of the combustion chamber 14 and connected to an exhaust pipe 23, for example, of a smoking or curing chamber, for the exhaust gas to be incinerated. The combustion pipe 12 is thermally insulated within the housing 10 against the outside by means of stone wool 26. In the illustrative embodiment shown in FIG. 1 the incinerator is set up upon a horizontal roof surface 30 through into which the exhaust gas pipe 23 extends, with the help of bearing support 28, with combustion chamber 14 running diagonally upwards from the burner 18 to the flue gas conduit 20.

Figure 4:
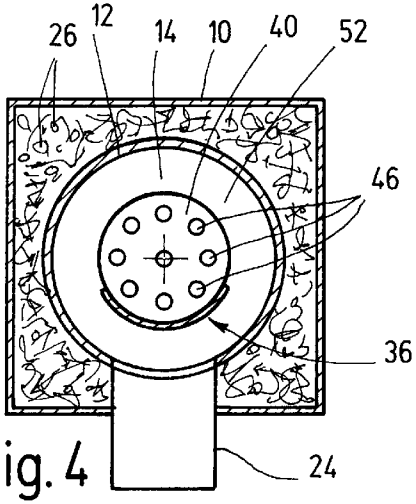
FIG. 4 a section along the section line IV—IV of FIG. 2.
Figure 3:
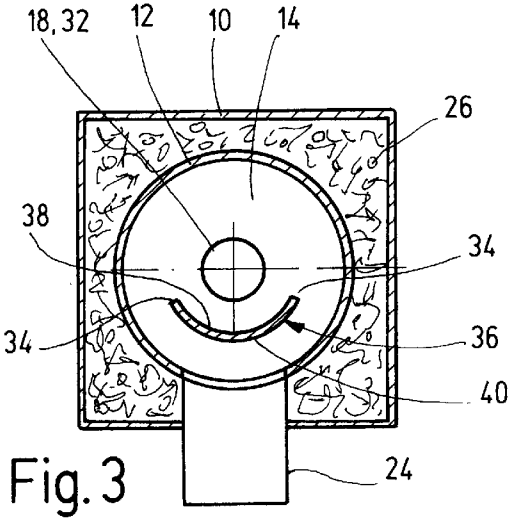
FIG. 3 a section along the section line III—III of FIG. 2.

The input conduit 24 opens radially into the combustion chamber 14 in the vicinity of the burner. In order to achieve a better mixing of the exhaust gas with the flame from flame pipe 32 of burner 18, there is situated in the combustion chamber, eccentrically, on the side of the input conduit 24, a conduction/deflection plate 36, which can be flowed by at its side edges, of which the inner surface 38 serves as conduction surface for the flame emitted from the burner 18 axially into the combustion chamber 14, and of which the outer surface 40 serves as the conduction and deflection plate for the exhaust gases entering the combustion chamber 14 via the input conduit 24 with radial flow component. The conduction/deflection plate 36 extends essentially axially parallel from the burner 18 out over the width of the input conduit 24, so that the flame is completely shielded with respect to the exhaust gas flowing in in close proximity. As can be seen from FIGS. 3 and 4, the conduction/deflection plate 36 is formed as a curved sheet forming part of a cylinder and essentially concentric with the combustion chamber 14.

Further there is to be found downstream of input conduit 24 baffle plate 44 located axially centrally, oriented transverse to the longitudinal axis 42 of the combustion chamber 14, which has a smaller diameter than the combustion chamber 14 as well as perforations 46 for the passage of flames. The baffle plate 44 is connected with the conduction/deflection plate 36 via axially parallel spacers or connector pieces 48 and therewith exhibits a short separation from the free end 50 of the conduction/deflection plate 36.

In axial separation from the baffle plate 44 there is located a ring 52 concentric to the longitudinal axis 42 and radially extending into the combustion chamber 14, reducing the flow cross-section of the combustion chamber. The cross-sectional constriction ensures a turbulence and better mixing of the exhaust gases with the flame gases.

Down stream of ring 52 there are at various distances provided a further baffle plate 54 with perforation and a further ring 56 reducing the pipe cross-section of the combustion chamber 14, which leads to a better mixing of the exhaust gas with the flame gases and an increase in the flame temperature. The baffle plate 54 is welded to the inner surface of the combustion chamber 12 with radial spacers 58.

In summary the following is to be concluded: The invention concerns an incinerator for combustion of exhaust gases containing organic substances. The incinerator preferably exhibits a longitudinally extending, preferably cylindrical combustion chamber 14, a burner 18 which engages with a flame tube 32 axially centrally at one end of the combustion chamber 14, preferably supplied with heating oil or heating gas, an exhaust conduit provided on the exhaust end of the combustion chamber 14, and an input conduit 24 connected to the side of the combustion chamber 14. The input conduit opens into the combustion chamber 14 in proximity to the burner. In order to achieve a higher heat density and a more compact construction manner it is suggested in accordance with the invention that the combustion chamber 14 is provided with a conduction/deflection plate 36, eccentrically, on the side of the input conduit 24, which is bypassed by the flow at least at its sides. The inner surface 38 of the conduction/deflection plate 36 serves thereby as conduction surface for the flame emitted essentially axially from the burner 18 into the combustion chamber 14, while the outer surface 40 serves as conduction and deflection surface for the exhaust gas entering into the combustion chamber 14 via input conduit 24 with radial flow component. Further, there is provided at least one baffle plate 44, downstream of the input conduit, axially centrally, and oriented transverse to the longitudinal axis 42 of combustion chamber 14, with perforations 46 for the passage of flames.

EXAMPLE

In a tempering oven a vulcanizate is post-tempered on the basis of nitrile rubber (acrylonitrile butadiene styrene rubber) for a period of two to three hours at 170° C. The tempering oven was loaded with 211 Kg of material.

In the exhaust air conduit of the tempering oven the hydrocarbon concentration was measured with a total hydrocarbon analyzer on the basis of the measuring process described in Sheet 1, VDE-Guideline 3481. This is concerned with a nonspecific substance measuring process, which provided a sum signal for non- or, as the case may be, partially oxidized organic substances. The total hydrocarbon analyzer provides an overview of the total loading of the air with organic substances. Its short response time makes possible an online recordation of the emissions development. The device is calibrated with propane test gas. The thereby produced propane equivalents are converted to the parameter Total Carbon, which is concerned exclusively with the carbon content of the propane molecule.

The concentration of hydrocarbon($C_{tot}$) measured in the exhaust of the tempering oven averaged 1382 mg/m$^3$, thus far exceeding the permissible limit of 20 mg/m$^3$.

For reduction of the hazardous and aromatic substances an oil fired incinerator of the type in FIGS. 1 through 5 was connected to the exhaust conduit of the tempering oven. For this the exhaust conduit was connected with the inlet conduit of the incinerator. For determining total hydrocarbon concentration at the exhaust gas outlet of the combustion oven a further total hydrocarbon analyzer was connected there. The total hydro carbon content in the exhaust gas of the incinerator was measured averaging 4.6 mg/m$^3$, which corresponds to a reduction of the total carbon emissions of over 99%.

What is claimed is:

1. Incinerator for decomposing exhaust gases containing organic substances, comprising:

a longitudinally extending combustion chamber (14) having a burner end, an exhaust end and at least one side, a burner (18) which engages with a flame tube (32) axially centrally at the burner end of the combustion chamber (14), an exhaust flue conduit (20) provided on the exhaust end of the combustion chamber (14), an input conduit (24) connected to the side of the combustion chamber (14) for introduction of the exhaust gases to be decomposed, the input conduit opening into the combustion chamber (14) in proximity to the burner, and a longitudinally extending conduction/deflection plate (36) provided in the combustion chamber (14) between the flame tube and the input conduit (24), the conduction/deflection plate (36) formed of curved sheet metal forming part of a cylinder essentially concentric to the combustion chamber (14) and defining a flow-path for said exhaust gases to flow by said conduction/deflection plate, the conduction/deflection plate (36) having a flame-side surface (38) serving as conduction surface for the flame emitted from the burner (18) essentially axially in the combustion chamber (14), the conduction/deflection plate having an opposite surface for pre-heating the exhaust gases entering into the combustion chamber (14) with a radial flow component via input conduit (24).

2. Incinerator according to claim 1, wherein said flame tube is supplied with fuel selected from the group consisting of heating oil and heating gas.

3. Incinerator according to claim 1, wherein said combustion chamber is cylindrical.

4. Incinerator according to claim 1, wherein the conduction/deflection plate (36) extends essentially axially parallel out from the burner (18) over the width of the input conduit (24).

5. Incinerator according to claim 1, wherein at least one baffle plate (44) is provided axially centrally downstream of the input conduit (24) and oriented transverse to the longitudinal axis (42) of the combustion chamber, the baffle plate having a smaller cross-section than the combustion chamber (14) as well as perforations (46) for passage through of the flame.

6. Incinerator according to claim 5, wherein said flame tube is supplied with fuel selected from the group consisting of heating oil and heating gas.

7. Incinerator according to claim 5, wherein said combustion chamber is cylindrical.

8. Incinerator according to claim 5, wherein the baffle plate (44) is provided close to but spaced apart from the end (50) of the conduction/deflection plate (36) opposite the flame tube.

9. Incinerator according to claim 5, wherein the baffle plate (44) is connected with the conduction/deflection plate (36) via longitudinally extending parallel supports (48).

10. Incinerator according to claim 5, wherein two perforated baffle plates (44, 54) are provided in the combustion chamber (14) axially separated from each other, and wherein a ring (52) is provided in the area between said the baffle plates (44, 54) extending radially into the combustion chamber (14) and concentric to the longitudinal axis (42) of the combustion chamber (14), said ring (52) reducing the flow-through cross section.

11. Incinerator for decomposing exhaust gases containing organic substances, comprising:

a longitudinally extending combustion chamber (14) having a burner end, an exhaust end and at least one side, a burner (18) which engages with a flame tube (32) axially centrally at the burner end of the combustion chamber (14), an exhaust flue conduit (20) provided on the exhaust end of the combustion chamber (14), an input conduit (24) connected to the side of the combustion chamber (14) for introduction of the exhaust gases to be decomposed, the input conduit opening into the combustion chamber (14) in proximity to the burner, and a longitudinally extending conduction/deflection plate (36) provided in the combustion chamber (14) between the flame tube and the input conduit (24), the conduction/deflection plate (36) formed of curved sheet metal forming part of a cylinder essentially concentric to the combustion chamber (14) and defining a flow-path for said exhaust gases to flow by said conduction/deflection plate, the conduction/deflection plate (36) having a flame-side surface (38) serving as conduction surface for the flame emitted from the burner (18) essentially axially in the combustion chamber (14), the conduction/deflection plate having an opposite surface for pre-heating the exhaust gases entering into the combustion chamber (14) with a radial flow component via input conduit (24), wherein at least one baffle plate (44) is provided axially centrally downstream of the input conduit (24) and oriented transverse to the longitudinal axis (42) of the combustion chamber, the baffle plate having a smaller cross-section than the combustion chamber (14) as well as perforations (46) for passage through of the flame, wherein two perforated baffle plates (44, 54) are provided in the combustion chamber (14) axially separated from each other, and wherein a ring (52) is provided in the area between said the baffle plates (44, 54) extending radially into the combustion chamber (14) and concentric to the longitudinal axis (42) of the combustion chamber (14), said ring (52) reducing the flow-through cross section, and including an exhaust flue conduit (20) for venting exhaust gases leaving said combustion chamber (14) wherein one of said baffle plates (54) is inside said combustion chamber (14) and adjacent said exhaust flue conduit (20), and wherein a ring (56) is provided in the space between the exhaust flue conduit (20) and the baffle plate (54), said ring (56) extending radially into the combustion chamber (14), and thereby reducing the flow cross-section.

12. Incinerator according to claim 11, wherein said ring (56) is concentric to the longitudinal axis (42) of the combustion chamber (14).

13. Incinerator according to claim 5, wherein the combustion chamber is cylindrical, and wherein said cylindrical combustion chamber (14) is provided in a thermally insulated housing (10).

14. Incinerator according to claim 13, wherein said housing is parallelepiped shaped.

15. Incinerator for decomposing exhaust gases containing organic substances, comprising:

a longitudinally extending combustion chamber (14) having a burner end, an exhaust end and at least one side, a burner (18) which engages with a flame tube (32) axially centrally at the burner end of the combustion chamber (14), an exhaust flue conduit (20) provided on the exhaust end of the combustion chamber (14), an input conduit (24) connected to the side of the combustion chamber (14) for introduction of the exhaust gases to be decomposed, the input conduit opening into the combustion chamber (14) in proximity to the burner, and a longitudinally extending conduction/deflection plate (36) provided in the combustion chamber (14) between the flame tube and the input conduit (24), the conduction/deflection plate (36) formed of curved sheet metal forming part of a cylinder essentially concentric to the combustion chamber (14) and defining a flow-path for said exhaust gases to flow by said conduction/deflection plate, the conduction/deflection plate (36) having a flame-side surface (38) serving as conduction surface for the flame emitted from the burner (18) essentially axially in the combustion chamber (14), the conduction/deflection plate having an opposite surface for pre-heating the exhaust gases entering into the combustion chamber (14) with a radial flow component via input conduit (24), wherein at least one baffle plate (44) is provided axially centrally downstream of the input conduit (24) and oriented transverse to the longitudinal axis (42) of the combustion chamber, the baffle plate having a smaller cross-section than the combustion chamber (14) as well as perforations (46) for passage through of the flame, wherein the combustion chamber is cylindrical, and wherein said cylindrical combustion chamber (14) is provided in a thermally insulated housing (10), and wherein the housing (10) is set up upon a substrate (30) with a diagonally downwards directed burner end and with a diagonally upwards directed flue gas conduit (20).

16. Method for decomposing exhaust gases containing organic substances, said method comprising:

(a) providing an incinerator comprising:

a longitudinally extending combustion chamber (14) having a burner end, an exhaust end and at least one side, a burner (18) which engages with a flame tube (32) axially centrally at the burner end of the combustion chamber (14) and which projects a flame, an exhaust flue conduit (20) provided on the exhaust end of the combustion chamber (14), an input conduit (24) connected to the side of the combustion chamber (14) for introduction of said exhaust gases to be decomposed, the input conduit opening into the combustion chamber (14) in proximity to the burner, and a longitudinally extending conduction/deflection plate (36) provided in the combustion chamber (14) between the flame tube and the input conduit (24), the conduction/deflection plate (36) formed of curved sheet metal forming part of a cylinder essentially concentric to the combustion chamber (14) and defining a flowpath for said exhaust gases to flow by said conduction/deflection plate, the conduction/deflection plate (36) having a flame-side surface (38) serving as conduction surface for the flame emitted from the burner (18) essentially axially in the combustion chamber (14), the conduction/deflection plate having an opposite surface for pre-heating the exhaust gases entering into the combustion chamber (14) with a radial flow component via input conduit (24);

(b) introducing fuel into said combustion chamber through said flame tube to project a flame along the inner surface of the conduction/deflection place;

(c) introducing said exhaust gases containing organic substances into said combustion chamber with a radial component via said input conduit (24) to cause said exhaust gases to flow along and around the outer surface of the conduction/deflection plate, to be heated by said conduction/deflection plate and said combustion chamber wall, (d) causing said heated exhaust gases to be turbulently mixed with said flame and organic substances contained in said exhaust gases to be decomposed.

17. Method as in claim 16, wherein said combustion chamber is cylindrical.

18. Method as in claim 16, wherein said exhaust gases are selected from the group consisting of curing smoke and bakery exhaust gases, exhaust gases from rubber tempering ovens, volatile organic solvents, volatile aromatic and hazardous substances, and motor exhaust gases.

* * * * *